US009518325B2

(12) United States Patent
Bucci et al.

(10) Patent No.: US 9,518,325 B2
(45) Date of Patent: Dec. 13, 2016

(54) TREATED COATED ARTICLE AND PROCESS OF TREATING A COATED ARTICLE

(71) Applicant: GENERAL ELECTRIC COMPANY, Schenectady, NY (US)

(72) Inventors: David Vincent Bucci, Simpsonville, SC (US); Dennis William Cavanaugh, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 289 days.

(21) Appl. No.: 13/847,253

(22) Filed: Mar. 19, 2013

(65) Prior Publication Data

US 2014/0287260 A1 Sep. 25, 2014

(51) Int. Cl.
*C23C 28/02* (2006.01)
*C23C 10/26* (2006.01)

(52) U.S. Cl.
CPC ..... *C23C 28/022* (2013.01); *C23C 10/26* (2013.01); *C23C 28/021* (2013.01); *C23C 28/028* (2013.01); *Y10T 428/12535* (2015.01)

(58) Field of Classification Search
CPC ..... C23C 28/022
See application file for complete search history.

(56) References Cited

U.S. PATENT DOCUMENTS 3,953,193 A * 4/1976 Bessen ..... 75/253
4,142,023 A * 2/1979 Bornstein et al. ..... 428/680
5,496,562 A 3/1996 Burgoyne
5,756,126 A 5/1998 Burgoyne
5,807,527 A 9/1998 Burgoyne
5,972,386 A 10/1999 Burgoyne
5,985,327 A 11/1999 Burgoyne
6,129,991 A 10/2000 Warnes et al.
6,875,292 B2 4/2005 Worthing, Jr. et al.
2001/0053410 A1* 12/2001 Fernihough et al. ..... 427/142
2005/0031877 A1 2/2005 Gigliotti et al.
2009/0126833 A1 5/2009 Cavanaugh et al.
(Continued)

OTHER PUBLICATIONS

Strangman "Thermal-Mechanical Fatigue Life Model for Coated Superalloy Turbine Components" in Superalloys, 1992 ed Antolovich et al p. 795-804.*
(Continued)

*Primary Examiner* — Nathan Empie
(74) *Attorney, Agent, or Firm* — McNees Wallace & Nurick, LLC

(57) ABSTRACT

A process of treating a coated article and a treated article are disclosed. The process includes providing an article having a MCrAlY coating, applying an aluminide treatment onto the MCrAlY coating to form a treated MCrAlY coating, and outwardly forming β-phase material from the MCrAlY coating into the treatment. The applying is selected from the group consisting of soaking, spraying, brushing, dipping, pouring, pack cementation, vapor deposition, and combinations thereof. The treated article includes a substrate and a treated MCrAlY coating positioned on at least a portion of the substrate. The treated MCrAlY coating includes a β-phase aluminide in a spray-applied, brush-applied, pour-applied, dip-applied, pack cement-applied, vapor deposit-applied, or soaking-applied treatment.

15 Claims, 1 Drawing Sheet

(56) References Cited

U.S. PATENT DOCUMENTS

| | | | |
|---|---|---|---|
| 2009/0214773 | A1 | 8/2009 | Moran et al. |
| 2011/0076410 | A1 | 3/2011 | Skoog et al. |

OTHER PUBLICATIONS

Repair technologies borrowed from aeros produce high yields on F-Class blades, vanes, Combined Cycle Journal, Second Quarter 2005.

European Search Report and Written Opinion issued in connection with corresponding EP Application No. 14159100.8 dated Jun. 24, 2014.

* cited by examiner

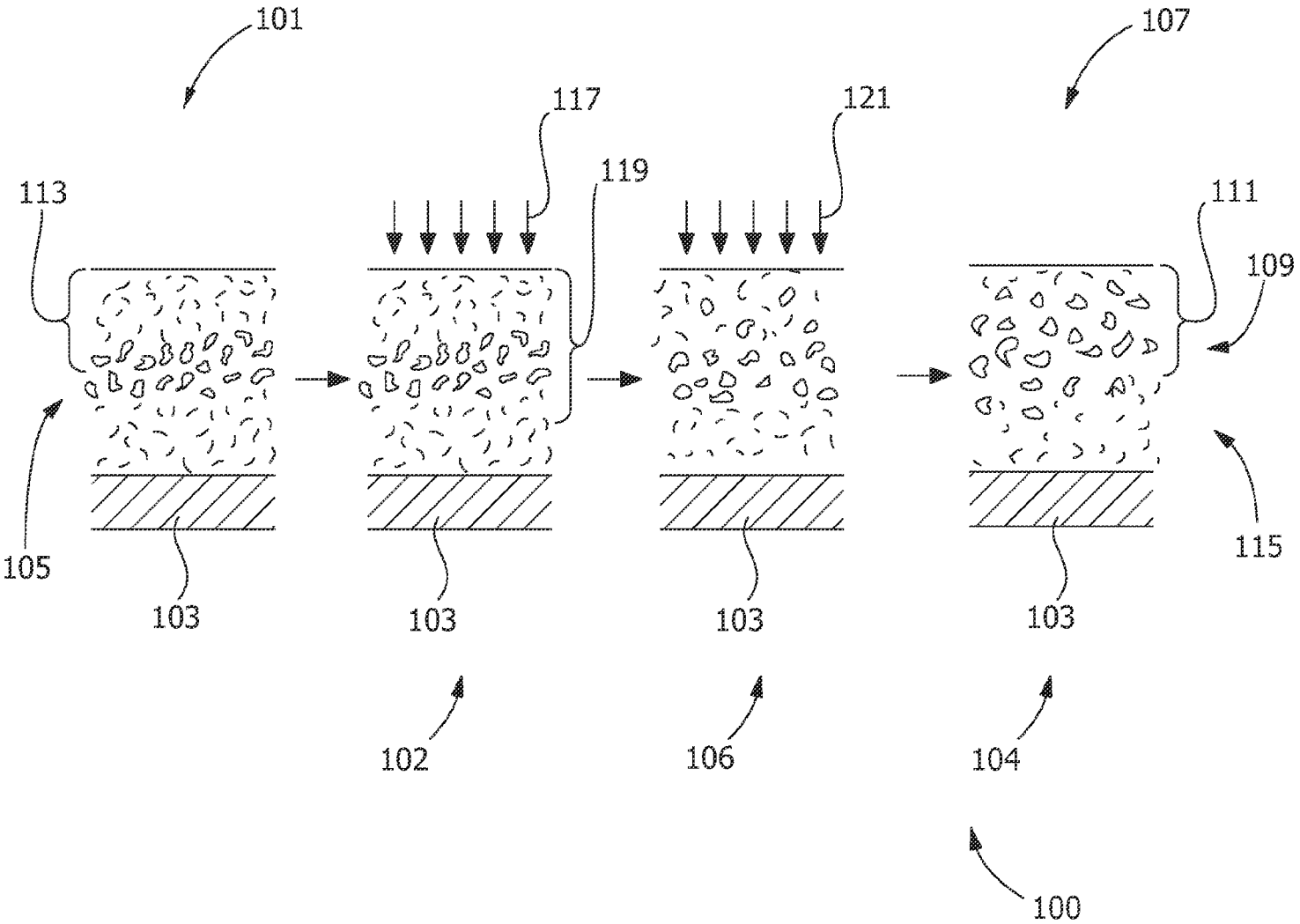
101
113
105
103
117
119
102
121
106
107
111
109
115
104
100

TREATED COATED ARTICLE AND PROCESS OF TREATING A COATED ARTICLE

FIELD OF THE INVENTION

The present invention is directed to articles and processes of treating articles. More particularly, the present invention is directed to aluminide treating of MCrAlY coatings within such articles and processes.

BACKGROUND OF THE INVENTION

Modern high-efficiency combustion turbines have firing temperatures that exceed about 2300° F. (1093° C.), and firing temperatures continue to increase as demand for more efficient engines continues. Many components that form the combustor and turbine (or "hot gas path") sections are directly exposed to aggressive hot combustion gases, for example, the combustion liner, the transition duct between the combustion and turbine sections, and the turbine stationary nozzles and rotating buckets and surrounding ring segments. In addition to thermal stresses, these and other components are also exposed to mechanical stresses and loads that further wear on the components. Such components are exposed to especially high temperatures in first and second stages of turbines.

Many cobalt-based and nickel-based superalloy materials traditionally used to fabricate the majority of turbine components used in the gas turbine engine are insulated from the oxidizing hot gas flow by coating the components with oxidation coatings such as McrAlY or diffusion aluminide, in order to survive long-term operation in this aggressive high-temperature combustion environment.

Thermal barrier coating systems often include three layers, a thermally grown oxide over a metallic bond coat, and a ceramic topcoat over the thermally grown oxide. Typically, the ceramic topcoat is formed from seven weight percent yttria-stabilized zirconia (7 YSZ). The 7YSZ exhibits low thermal conductivity while remaining phase stable at typical operating temperatures seen in gas turbine applications. Ceramic topcoats such as 7YSZ may have limited applicability and can be expensive to apply.

One such metallic bond coat is a MCrAlY coating, where M is iron, cobalt, and/or nickel. Another metallic bond coat is a diffusion aluminide coating, such as NiAl and $Ni_2Al_3$. MCrAlY coatings typically exhibit a two-phase microstructure, including β-phase material and γ-phase material. An NiAl beta phase is the aluminum rich phase which provides the aluminum source for thermally grown oxide growth. The presence of γ-phase material increases ductility, thereby improving thermal fatigue resistance. Traditionally, when engines include such MCrAlY coatings along a hot gas path, the coatings can oxidize, for example, when on blades or nozzles exposed to the high temperatures of first stage and second stage temperatures. Such high temperatures deplete β-phase material from the MCrAlY coatings. Upon reaching a predetermined depletion of the β-phase material, such MCrAlY coatings are repaired.

Known MCrAlY coating repair techniques include stripping MCrAlY coatings, for example, with an acid, and re-coating the article with a MCrAlY coating. Such techniques undesirably extend the duration of service periods for turbine components. Such stripping and re-coating can also result in undesirably high costs. Furthermore, improper stripping and re-coating can have an undesirable effect on alloys in the substrate.

Also, aluminide coatings have been limited to certain operational lives at temperatures based upon diffusion thickness limitations and/or may be brittle or produce craze-cracking during service, for example, due to inwardly-formed MCrAlY coatings being over-aluminized.

A MCrAlY-coated article and a process of treating a MCrAlY-coated article not suffering from the above drawbacks would be desirable in the art.

BRIEF DESCRIPTION OF THE INVENTION

In an exemplary embodiment, a process of treating a coated article includes providing an article having a MCrAlY coating, applying an aluminide treatment onto the MCrAlY coating to form a treated MCrAlY coating, and outwardly forming β-phase material from the MCrAlY coating into the treatment. The applying is selected from the group consisting of soaking, spraying, brushing, dipping, pouring, pack cementation, vapor deposition and combinations thereof.

In another exemplary embodiment, a process of treating a coated article includes providing an article having a MCrAlY coating, spraying an aluminide treatment onto the MCrAlY coating to form a treated MCrAlY coating, and outwardly forming β-phase material from the MCrAlY coating into the aluminide treatment.

In another exemplary embodiment, a β-treated article includes a substrate and a treated MCrAlY coating positioned on at least a portion of the substrate. The treated MCrAlY coating includes a β-phase aluminide in a spray-applied, brush-applied, pour-applied, dip-applied, pack cement-applied, vapor deposit-applied, or soaking-applied treatment.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

FIG. 1 is a schematic view of an article and an exemplary treated article treated according to an exemplary process according to the disclosure.

Wherever possible, the same reference numbers will be used throughout the drawings to represent the same parts.

DETAILED DESCRIPTION OF THE INVENTION

Provided are an exemplary treated MCrAlY-coated article and a process treating a MCrAlY-coated article. Embodiments of the present disclosure permit use of new materials in turbine buckets or nozzles exposed to the high temperatures of first stage and second stage temperatures, replenish depleted β-phase material from MCrAlY coatings, permit repair of MCrAlY coatings without stripping and/or re-coating, shorten the duration of service periods for turbine components having MCrAlY coatings, reduce costs associated with stripping and re-coating of MCrAlY coatings, permit use of aluminide coatings without substantial sacrifice of oxidation resistance and/or corrosion resistance, or combinations thereof.

As shown in FIG. 1, prior to being treated, an article 101 includes a substrate 103 and a MCrAlY coating 105 or bond coat positioned on at least a portion of the substrate 103. The article 101 is any suitable component, such as, a turbine component or an engine component. Exemplary components include combustor liners, transition ducts (for example, between combustion and turbine sections), stationary nozzles, rotating buckets, shrouds, other metal or metallic components, or combinations thereof.

The article 101 is treated to form the treated article 107. The treated article 107 includes outwardly-formed β-phase material 109, such as, a β-phase aluminide and, in some embodiments, other suitable β-phase intermetallic material, within a rejuvenation region 111 of the treated article 107 corresponding to a depletion region 113 of the article 101. The depletion region 113 includes a reduced amount of β-phase material, for example, based upon oxidation and/or operational use of the article 101, prior to applying of an aluminide treatment 117. As will be appreciated by those skilled in the art, the outwardly formed β-phase material 109 and inwardly formed β-phase material (not shown) may be formed. Use of the term "outwardly" refers to having a greater characteristic of outward forming β-phase material than inward formed coatings which use NiAl and $Ni_2Al_3$ β-phase material. For example, outwardly-formed aluminides include primarily β-NiAl as nickel diffuses outward to react with the Al source.

The treated article 107 is formed according to a treating process 100. The treating process 100 includes applying the aluminide treatment 117 (step 102) to the MCrAlY coating 105 to form a treated MCrAlY coating 115 (step 104). The aluminide treatment 117 is a slurry, a gel, or any other suitable material capable of application to the MCrAlY coating 105. The aluminide treatment 117 includes an aluminide (for example, NiAl and/or $Ni_2Al_3$) capable of forming the treated MCrAlY coating, or a combination of the aluminide and a chromide, silicon, or any other intermetallic material. In one embodiment, the aluminide treatment 117 includes aluminum at a concentration, by weight, of between about 12% and about 32%, between about 15% and about 25%, between about 15% and about 20%, between about 20% and about 25%, between about 20% and about 30%, between about 25% and about 30%, about 15%, about 20%, about 25%, about 30%, or any suitable combination, sub-combination, range, or sub-range thereof.

In one embodiment, the MCrAlY coating 105 and/or other portions of the article 101 are prepared prior to the applying of the aluminide treatment 117 by any suitable technique(s). Suitable preparation techniques include, but are not limited to, grit blasting, cleaning, grinding, masking, machining, or combinations thereof. In one embodiment, preparation techniques remove a portion, substantially all, or all oxidized material on the MCrAlY coating 105.

The applying of the aluminide treatment 117 (step 102) is by soaking the MCrAlY coating 105 in the aluminide treatment 117, dipping the MCrAlY coating 105 in the aluminide treatment 117, pouring the aluminide treatment 117 onto the MCrAlY coating 105, spraying the aluminide treatment 117 onto the MCrAlY coating 105, brushing the aluminide treatment 117 onto the MCrAlY coating 105, and/or any other application process capable of forming the treated MCrAlY coating 115. In one embodiment, the aluminide treatment 117 diffuses into the MCrAlY coating 105, for example, by a depth 119. Suitable depths 119 are at least about 1 mil, at least about 1.5 mils, at least about 2 mils, about 1 mil, about 1.5 mils, about 2 mils, within a range of between about 1 mil and about 2 mils, within a range of between about 1 mil and about 1.5 mils, within a range of between about 1.5 mils and about 2 mils, or any suitable combination, sub-combination, range, or sub-range thereof.

The applying of the aluminide treatment 117 (step 102) is under operational conditions permitting the formation of the treated MCrAlY coating 115. For example, in one embodiment, the aluminide treatment 117 is applied for a predetermined duration, such as, between about 1 and about 6 hours, between about 1 and about 3 hours, between about 3 and about 6 hours, about 1 hour, about 3 hours, about 6 hours, or any suitable combination, sub-combination, range, or sub-range thereof. Additionally or alternatively, the applying of the aluminide treatment 117 (step 102) is followed by or done while heating the aluminide treatment 117 and/or the article 101 (step 106). For example, in one embodiment, the article 101 is positioned in an atmospheric furnace and the heating (step 106) is performed, for example, in an inert atmosphere, such as with argon gas and/or with low oxygen content. Heat 121 includes suitable temperatures, for example, temperatures between about 1600° F. and 2200° F., between about 1900° F. and 2150° F., between about 1950° F. and 2100° F., at about 1975° F., at about 2000° F., at about 2050° F., or any suitable combination, sub-combination, range, or sub-range thereof. In one embodiment, the heating (step 106) is at a temperature capable of forming a ductile intermetallic material, such as a ductile aluminide, for example, having a strain range of about 4% and/or permitting the treated article 107 to be devoid or substantially devoid of cracking formed by application of a brittle aluminide.

The applying of the aluminide treatment 117 (step 102) and the heating (step 106) rejuvenates the depletion region 113 of the MCrAlY coating 105 to form the treated MCrAlY coating 115 (step 104). The formation of the treated MCrAlY coating 115 (step 104) includes outwardly forming β-phase material as the outwardly-formed β-phase material 109 from the MCrAlY coating 105 into the aluminide treatment 117.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A process of treating a coated article, the process comprising:

commencing a service period of a gas turbine, the service period being the period throughout which operation of the gas turbine is suspended, the gas turbine including the coated article having a MCrAlY coating;

during the service period, applying an aluminide treatment including at least one of NiAl and $Ni_2Al_3$ onto the MCrAlY coating to form a treated MCrAlY coating, the aluminide treatment diffusing into the MCrAlY coating by a depth of at least 1 mil, the depth of the MCrAlY into which the aluminide treatment has diffused possessing a strain range of about 4%; and outwardly forming (β-phase material from the MCrAlY coating into the treatment;

wherein the applying is selected from the group consisting of soaking, spraying, brushing, dipping, pouring, and combinations thereof, and the process is performed without stripping any MCrAlY from the coated article or re-coating the coated article with MCrAlY during the service period.

2. The process of claim 1, comprising heating the aluminide treatment to a predetermined temperature range of between about 1600° F. and 2200° F.

3. The process of claim 1, comprising heating the aluminide treatment to a predetermined temperature range of between about 1900° F. and 2150° F.

4. The process of claim 1, comprising heating the aluminide treatment to a predetermined temperature range of between about 1950° F. and 2050° F.

5. The process of claim 1, wherein the MCrAlY coating includes a depletion of (β-phase aluminide prior to the applying of the aluminide treatment.

6. The process of claim 1, wherein the aluminide treatment diffuses into the MCrAlY coating by a depth of about 2 mils.

7. The process of claim 1, comprising providing the aluminide treatment with aluminum at a concentration, by weight, of between about 15% and about 30%.

8. The process of claim 1, comprising providing the aluminide treatment with aluminum at a concentration, by weight, of about 20%.

9. The process of claim 1, wherein the aluminide treatment includes NiAl.

10. The process of claim 1, wherein the aluminide treatment includes $Ni_2Al_3$.

11. The process of claim 1, wherein the aluminide treatment is a slurry.

12. The process of claim 1, comprising providing an inert atmosphere for the process.

13. A process of treating a coated article, the process comprising:

commencing a service period of a gas turbine, the service period being the period throughout which operation of the gas turbine is suspended, the gas turbine including the coated article having a MCrAlY coating;

during the service period, spraying an aluminide treatment including at least one of NiAl and $Ni_2Al_3$ onto the MCrAlY coating to form a treated MCrAlY coating, the aluminide treatment diffusing into the MCrAlY coating by a depth of at least 1 mil, the depth of the MCrAlY into which the aluminide treatment has diffused possessing a strain range of about 4%; and outwardly forming (β-phase material from the MCrAlY coating into the aluminide treatment, wherein the process is performed without stripping any MCrAlY from the coated article or re-coating the coated article with MCrAlY during the service period.

14. The process of claim 13, wherein the (β-phase material includes (β-phase aluminide.

15. The process of claim 13, wherein the MCrAlY coating includes a depletion of (β-phase aluminide prior to the spraying of the aluminide treatment.

* * * * *